US009452304B2

(12) United States Patent
Ryu et al.

(10) Patent No.: US 9,452,304 B2
(45) Date of Patent: Sep. 27, 2016

(54) NON-DIRECTIONAL SMOKE CONTROL DAMPER HAVING CHAIN GEAR TYPE BLADE ADVANCING/RETREATING DEVICE

(71) Applicant: DAELIM INDUSTRIAL CO., LTD., Seoul (KR)

(72) Inventors: Hyung Kyou Ryu, Pyeongtaek-si (KR); Sang Hwan Bae, Incheon (KR)

(73) Assignee: Daelim Industrial Co., Ltd., Seoul (KR)

( * ) Notice: Subject to any disclaimer, the term of this patent is extended or adjusted under 35 U.S.C. 154(b) by 651 days.

(21) Appl. No.: 14/001,663

(22) PCT Filed: Feb. 14, 2013

(86) PCT No.: PCT/KR2013/001142

§ 371 (c)(1),
(2) Date: Aug. 26, 2013

(87) PCT Pub. No.: WO2013/122393

PCT Pub. Date: Aug. 22, 2013

(65) Prior Publication Data

US 2014/0065941 A1 Mar. 6, 2014

(30) Foreign Application Priority Data

Feb. 16, 2012 (KR) ..... 10-2012-0015622

(51) Int. Cl.
*F24F 13/08* (2006.01)
*A62C 2/18* (2006.01)
(Continued)

(52) U.S. Cl.
CPC . *A62C 2/18* (2013.01); *A62C 2/20* (2013.01); *F24F 2011/0098* (2013.01)

(58) Field of Classification Search
CPC ..... F24F 2011/0098; F24F 13/10; F24F 2013/1433
USPC ..... 454/257, 265, 274, 311, 313, 314, 318, 454/323, 342, 352, 357; 137/78.1, 78.5, 80
See application file for complete search history.

(56) References Cited

U.S. PATENT DOCUMENTS 2,369,303 A * 2/1945 Kurth ..... F24F 13/062 3/62
2,398,938 A * 4/1946 Honerkamp ..... F24F 13/06 454/313

(Continued)

FOREIGN PATENT DOCUMENTS

CN 102869410 B * 3/2015 ..... F24F 11/0086
KR 20-1998-0058573 U 10/1998

(Continued)

OTHER PUBLICATIONS

Cha, J Y et al, KR 2016038141 A, Apr. 7, 2016, machine translation through EAST.*

*Primary Examiner* — Steven B McAllister
*Assistant Examiner* — Frances F Hamilton
(74) *Attorney, Agent, or Firm* — Fenwick & West LLP

(57) ABSTRACT

A non-directional smoke control damper includes a central blade (11), a plurality of outer blades (12) and a blade advancing/retreating device; an outer edge of the central blade (11) overlaps with an opening edge of the plurality of outer blades (12); a support shaft (110) is disposed to pass through the overlapping portion of the edges; a rear end of the support shaft (110) is coupled through a shaft coupling plate (230); and if the central blade (11) advances forwards, the plurality of outer blades (12) advance forwards in order so that a gap is formed at each edge between the central blade (11) and an adjacent outer blade and between a prior-order outer blade and a posterior outer blade to form a blowing passage, thereby allowing an air current to flow into the vestibule through the blowing passage.

2 Claims, 18 Drawing Sheets

(51) Int. Cl.
*A62C 2/20* (2006.01)
*F24F 11/00* (2006.01)

(56) References Cited

U.S. PATENT DOCUMENTS 4,800,804 A * 1/1989 Symington ..... F24F 11/0001 137/73
5,060,557 A * 10/1991 Dunn ..... A62C 2/14 137/601.06
5,810,662 A * 9/1998 Van Becelaere ..... A62C 2/14 454/284
6,053,809 A * 4/2000 Arceneaux ..... F24F 7/06 454/228
8,808,074 B2 * 8/2014 Kim ..... F24F 13/062 3/62
2004/0142654 A1 * 7/2004 Stammer ..... F24F 7/00 454/357
2013/0005236 A1 * 1/2013 Kim ..... F24F 11/0086 454/238

FOREIGN PATENT DOCUMENTS

KR 10-2001-0113079 A 12/2001
KR 20-00316848 Y 6/2003
KR 10-2010-0048674 5/2010
KR 10-2010-0122989 A 11/2010
KR 10-2011-0047742 A 5/2011
KR 101303332 B1 * 9/2013
KR 101525186 B1 * 6/2015
KR 2016038141 A * 4/2016 ..... A62C 2/06

* cited by examiner

NON-DIRECTIONAL SMOKE CONTROL DAMPER HAVING CHAIN GEAR TYPE BLADE ADVANCING/RETREATING DEVICE

TECHNICAL FIELD

This disclosure relates to a smoke control damper installed in a vestibule between an indoor space and a stair hall in a building to prevent smoke from spreading to an evacuation way when fire occurs at the indoor space so that persons in the building may safely evacuate from the smoke.

BACKGROUND ART

A building such as a skyscraper or an apartment has a stair hall which serves as an evacuation passage for allowing persons in the building to evacuate. In addition, a vestibule is present between an indoor space such as a living room and the stair hall, and a smoke control damper is installed in the vestibule. If fire occurs, an air current is supplied into the vestibule by means of a smoke control damper to form an air egress velocity toward the indoor space, which prevents smoke from flowing into the stair hall and allows persons in the building to safely evacuate through the stair hall. A system for installing a smoke control damper in a building and relevant construction regulations are disclosed in Korean Unexamined Patent Publication No. 10-2011-47742, and a conventional smoke control damper is disclosed in Korean Utility Model Registration No. 20-316848.

FIG. 1 is a schematic cross-sectional view showing a rotary switch blade 13 provided at a general smoke control damper, which is at a closed location, and FIG. 2 is a schematic cross-sectional view showing the rotary switch blade 13 which rotates and comes to an open location. As shown in FIGS. 1 and 2, the conventional smoke control damper includes a plurality of rotary switch blades 13 successively arranged in a row in the vertical direction. In the state depicted in FIG. 1, the rotary switch blades 13 are vertically located and close a blowing passage of the smoke control damper. In the state depicted in FIG. 2, the plurality of rotary switch blades 13 are at horizontal locations and open the blowing passage of the smoke control damper. In the state of FIG. 1 as described above, if the plurality of rotary switch blades 13 rotates by an operation of a motor and comes into horizontal locations, the blowing passage of the smoke control damper is opened as shown in FIG. 2. Therefore, an air current is blown through the blowing passage between the rotary switch blades 13, thereby forming an air egress velocity with respect to a shelter door which allows a person to move from an indoor space to a vestibule.

Therefore, in a conventional smoke control damper, all rotary switch blades 13 are kept in a horizontal or inclined state depending on the degree of rotation of the rotary switch blades 13, and accordingly an air current supplied to the vestibule has a specific direction through the blowing passage formed by a gap between the rotary switch blades 13. However, if the conventional smoke control damper for opening or closing the blowing passage by rotation of the plurality of rotary switch blades 13 is left unused for a long time, the rotary switch blades 13 may not easily rotate. If the rotary switch blades 13 do not rotate to a perfectly horizontal state as described above, the rotary switch blades 13 are in an inclined state, which also brings the blowing passage into an inclined state. In this case, an air egress velocity is not regularly formed at the shelter door.

In particular, in a conventional smoke control damper, the direction of the air egress velocity varies according to the direction toward the shelter door. In other words, the direction of the air egress velocity is different depending on whether the smoke control damper faces the shelter door or the smoke control damper is perpendicular to the shelter door. This is because the air current supplied to the vestibule through the blowing passage formed by a gap between the rotary switch blades 13 of the general smoke control damper has a specific direction. Due to such a direction of air current, the air egress velocity formed by the air current supplied through the blowing passage of the rotary switch blade 13 may not be formed to flow toward the shelter door but be formed to flow from the shelter door to the vestibule, which makes smoke spread more to the stair hall and even presses the shelter door not to be opened toward the vestibule.

Therefore, when installing the conventional smoke control damper at the vestibule, the location of a shelter door should be taken into consideration, and the building should be designed in consideration of relations between the smoke control damper and the shelter door, which gives many limitations in an actual building designing work.

DISCLOSURE

Technical Problem

This disclosure is directed to allowing an air current supplied to a vestibule to uniformly spread in the vestibule by means of a smoke control damper without being inclined to a specific direction.

In addition, the present disclosure is directed to providing a smoke control damper which may form an air egress velocity in a direction capable of preventing diffusion of smoke so that the air does not disturb opening of a shelter door without flowing into a stair hall, thereby allowing the shelter door to be easily opened toward the vestibule.

Moreover, the present disclosure is directed to providing a non-directional smoke control damper which may be installed regardless of a location of a shelter door, thereby removing limitations in a building designing procedure.

Technical Solution

In one general aspect, there is provided a smoke control damper installed in a vestibule between an indoor space and a stair hall and opened or closed to allow an air current of an outside air to flow into the vestibule; the non-directional smoke control damper includes a central blade, a plurality of outer blades having an opening and arranged in order to surround an edge of the central blade, and a blade advancing/retreating device for moving the central blade forwards or backwards; an outer edge of the central blade overlaps with an opening edge of an outer blade adjacent thereto, and a support shaft is disposed to pass through the overlap portion in the horizontal direction; the plurality of outer blades are arranged so that an outer edge of a prior-order outer blade overlaps with an opening edge of a posterior outer blade adjacent thereto and a support shaft is respectively disposed to pass through the overlapping portion; a hooking member for pushing the rear surface of an adjacent outer blade is provided at the support shaft to be spaced apart from the front end; the rear end of the support shaft is coupled through a shaft coupling plate disposed with a gap at the rear of the outer blade, and a stopper is provided at the rearmost end of the support shaft provided through the shaft coupling plate to prevent the support shaft from being excessively pulled; the blade advancing/retreating device includes a motor located spaced apart from a rear surface of the central blade, a rotating gear unit configured to pivot by the motor, and a chain gear having one end coupled to the rear surface of the central blade, the chain gear being engaged with the rotating gear unit to move by means of pivotal movement of the rotating gear unit, which makes the central blade advance or retreat; and when the central blade advances forwards by the blade advancing/retreating device, the plurality of outer blades advance forwards in order, forming a gap at an edge of each outer blade between the central blade and an adjacent outer blade and between a prior-order outer blade and a posterior outer blade to create a blowing passage, thereby allowing an air current to flow into a vestibule through the blowing passage.

In addition, in the non-directional smoke control damper of the present disclosure as described above, a redirection plate is installed at the rear of the central blade with a gap from the rear surface of the central blade and allows the chain gear disposed and moved in the vertical direction to move in the horizontal direction along which the central blade advances or retreats.

Advantageous Effects

According to the present disclosure, since the smoke control damper has a non-directional characteristic, the air current supplied to the vestibule through the smoke control damper may uniformly spread in the vestibule without being inclined to a specific direction between a central blade and an outer blade and between outer blades.

Therefore, according to the present disclosure, an air egress velocity is formed in a direction capable of preventing smoke from spreading to a shelter door so that the smoke does not flow into the stair hall, and also opening of the shelter door is not disturbed, thereby ensuring the shelter door to be easily opened toward the vestibule.

In addition, according to the present disclosure, since the smoke control damper may be installed regardless of a location of the shelter door, limitations in a building designing procedure may be removed.

BEST MODE

Figure 1:
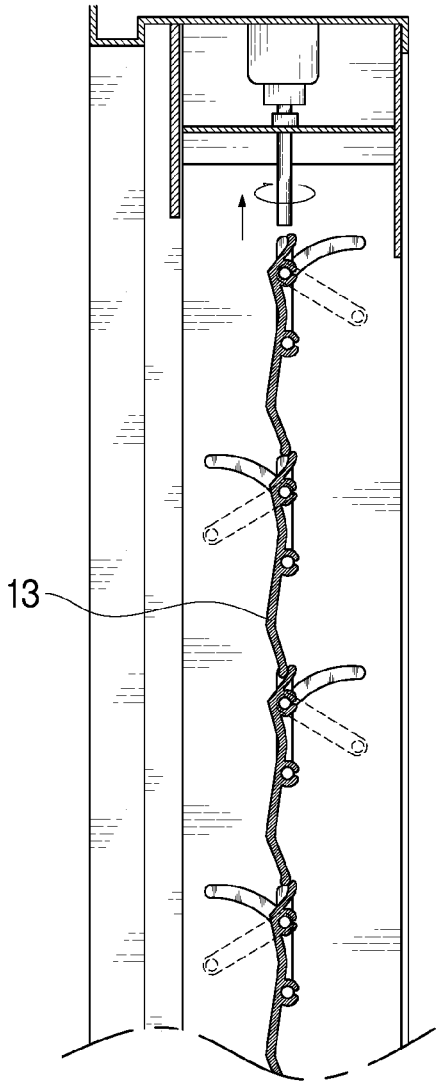
PRIOR ART Fig. 1
FIGS. 1 and 2 are schematic partial cross-sectional views showing a general smoke control damper.
Figure 2:
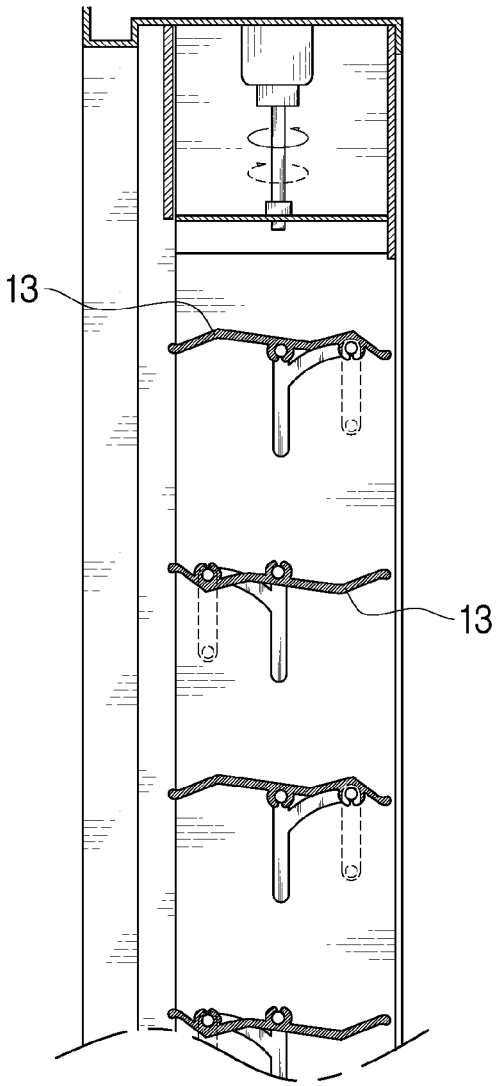
PRIOR ART Fig. 2

Hereinafter, an embodiment of the present disclosure will be described with reference to the accompanying drawings. Even though the present disclosure is described with reference to the embodiment depicted in the drawings, this is just an example, and the spirit, essence and operations of the present disclosure are not limited thereto.

Figure 3:
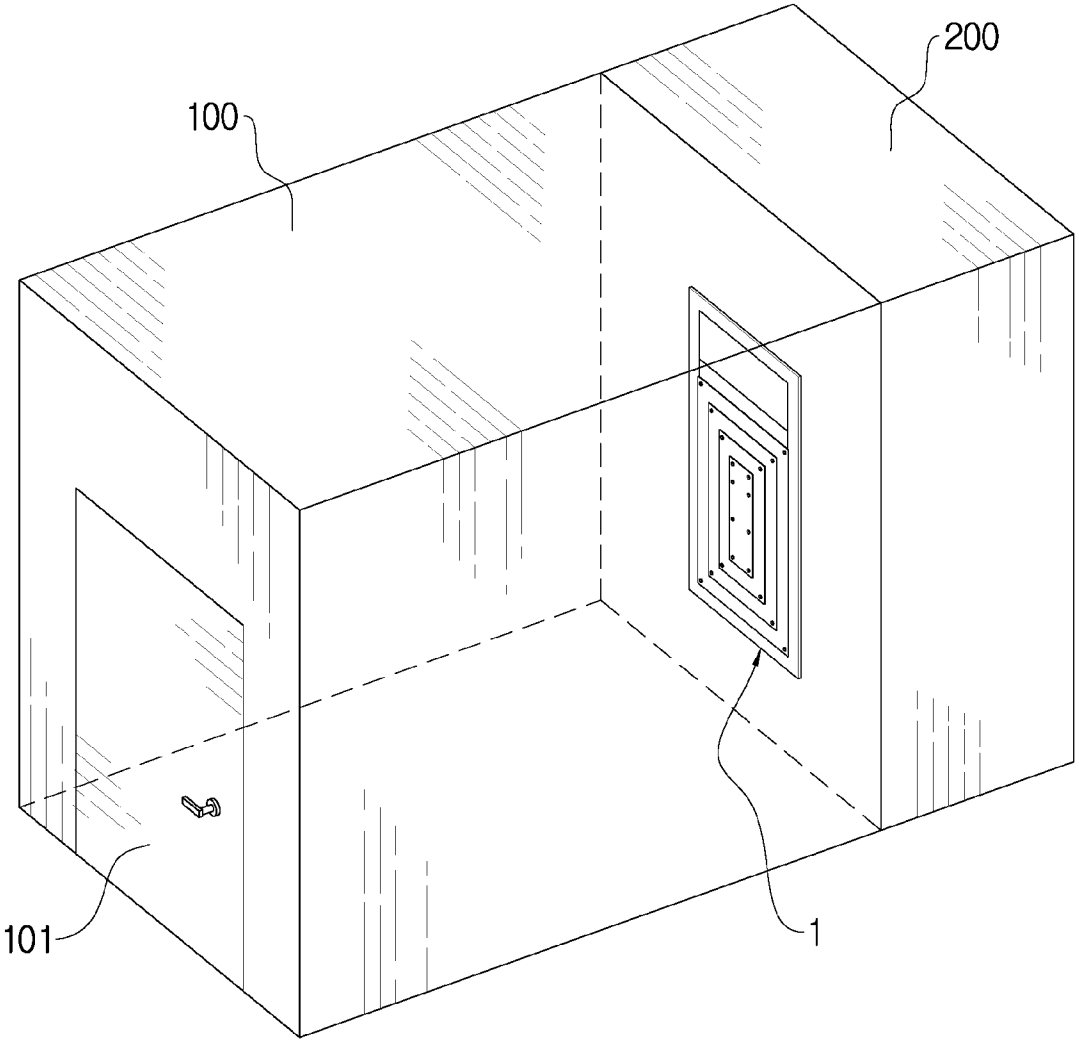
FIGS. 3 and 4 are schematic perspective views showing a smoke control damper according to the present disclosure, which is installed in a vestibule.
Figure 4:
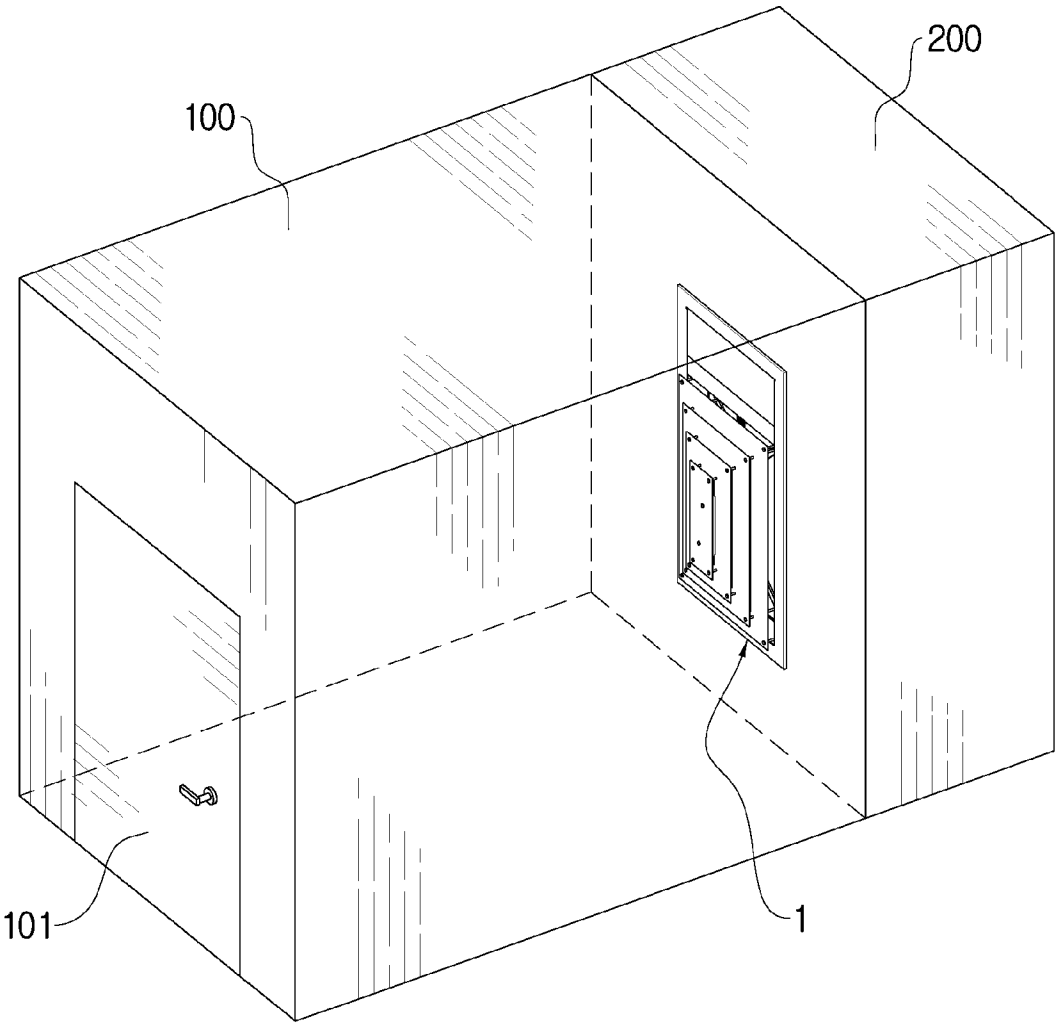

FIGS. 3 and 4 are schematic perspective views showing a smoke control damper 1 according to the present disclosure, which is installed in a vestibule 100 formed between a stair hall 200 and an indoor space. Here, FIG. 3 shows that the smoke control damper 1 of the present disclosure is in a closed state, and FIG. 4 shows that the smoke control damper 1 of the present disclosure is in an opened state. In FIG. 4, arrows shown in a radial direction around of the smoke control damper 1 represent a direction of an air current flowing into the vestibule from the smoke control damper 1 in an opened state.

As shown in FIGS. 3 and 4, the smoke control damper 1 according to the present disclosure is installed at a wall, which has a passage for supplying an outside air at a rear portion thereof, among walls of the vestibule 100. The smoke control damper 1 of the present disclosure does not blow the air current to a specific portion of the vestibule 100 but generates an air current non-directionally so that the air current uniformly spreads in the vestibule 100. Therefore, as shown in the figures, in the present disclosure, the smoke control damper 1 may be installed to face a shelter door 101 which is opened from the indoor space to the vestibule, or may be installed at any wall in the vestibule 100 regardless of a location of the shelter door 101 if the wall has a passage for supplying an outside air.

Figure 5:
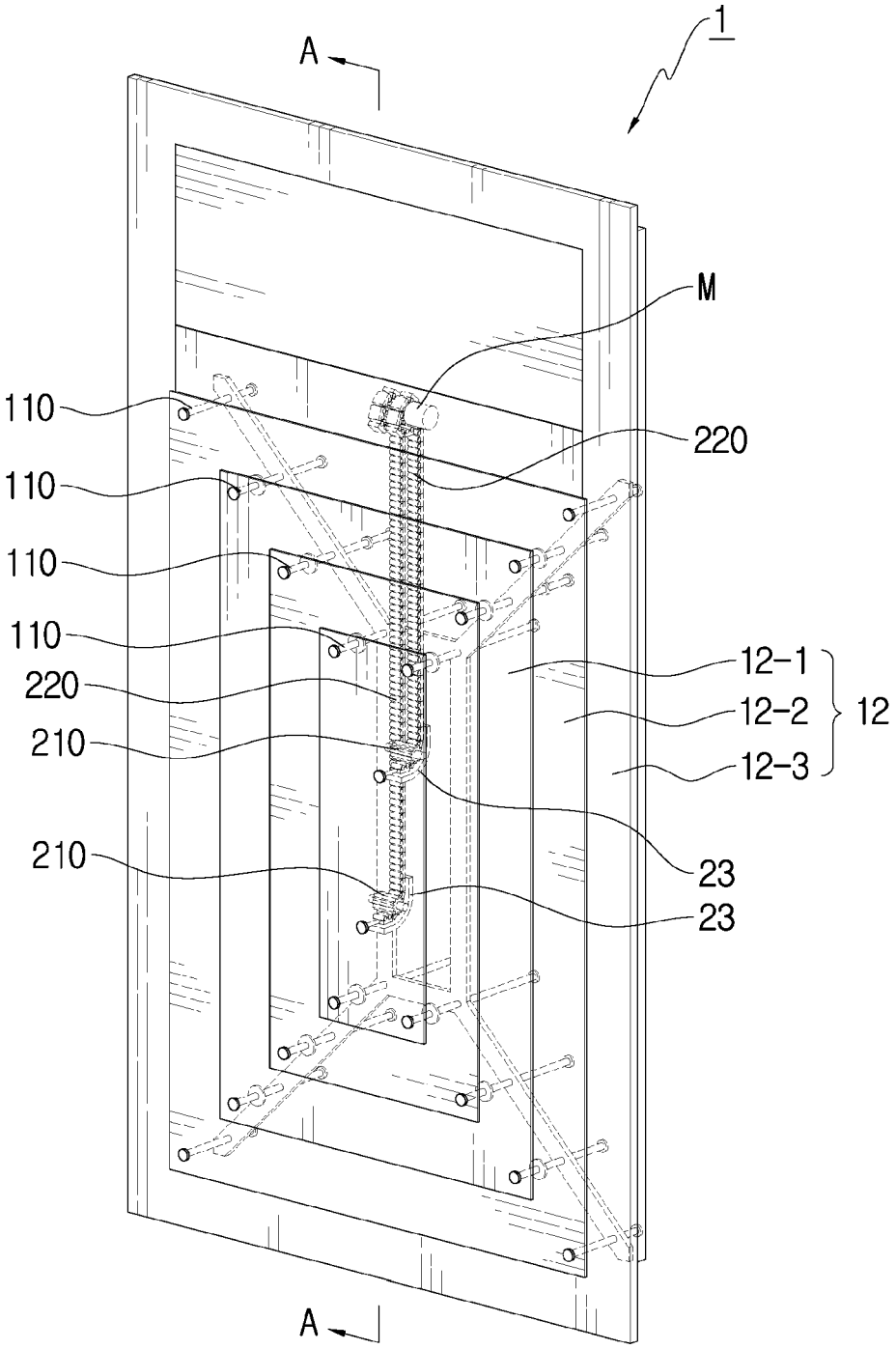
FIGS. 5 and 6 are respectively a schematic perspective view observed from the front and a schematic perspective view observed from the rear, showing the smoke control damper according to the present disclosure, which is in a closed state.
Figure 6:
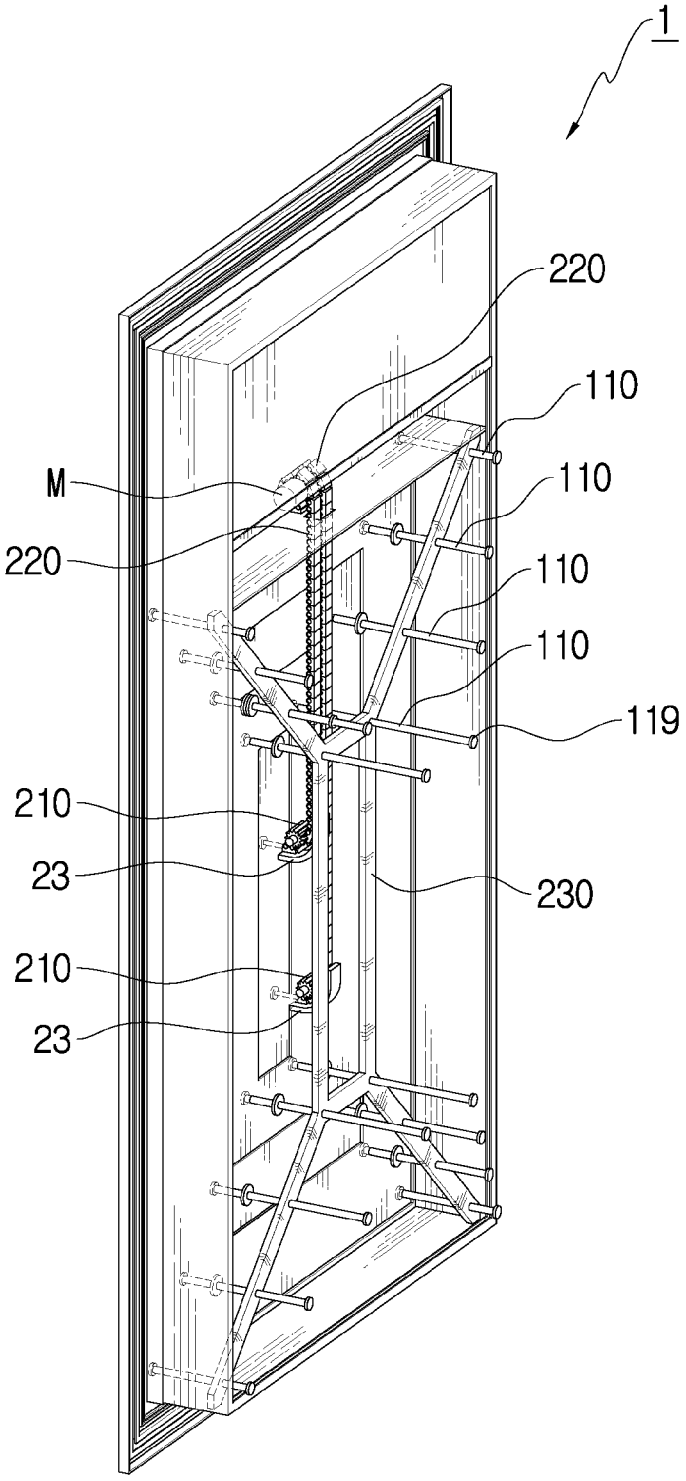
Figure 7:
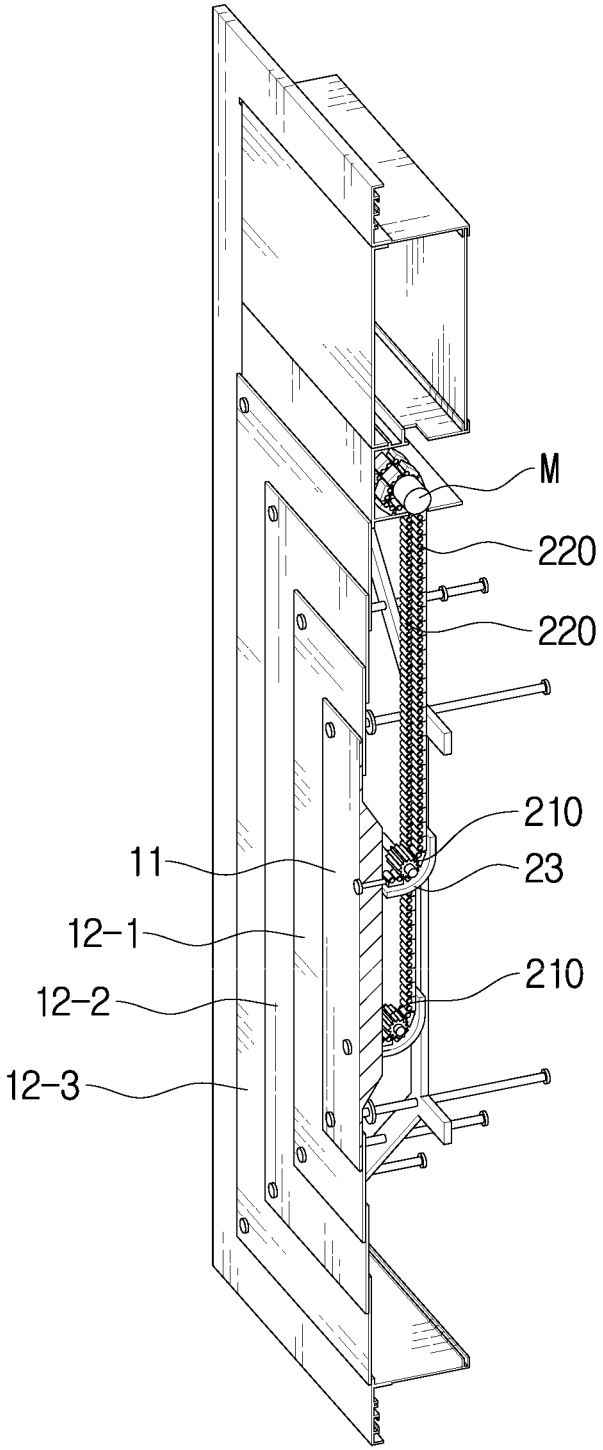
FIG. 7 is a schematic partially-sectioned perspective view, taken along the line A-A of FIG. 5.
Figure 8:
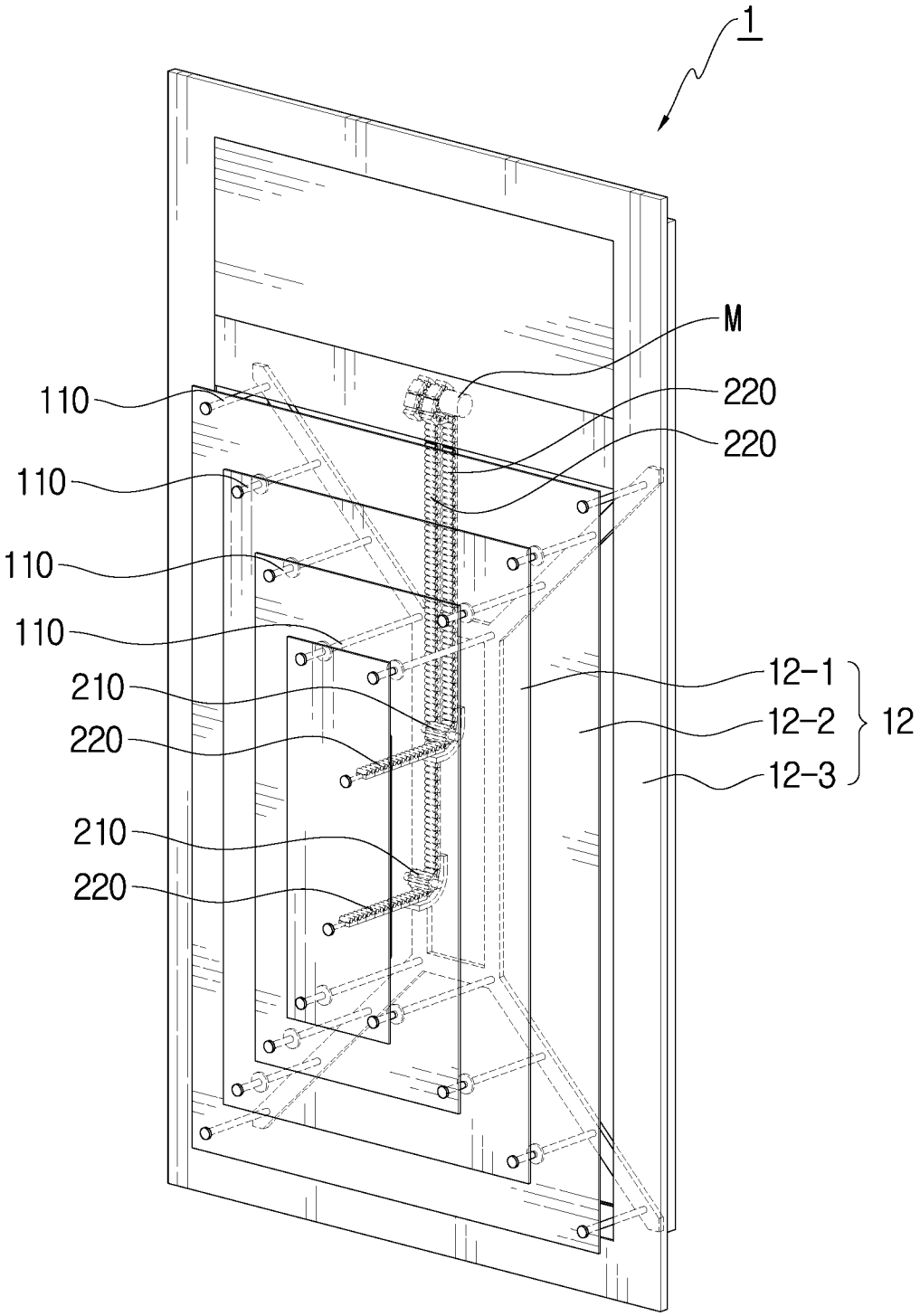
FIGS. 8 and 9 are respectively a schematic perspective view observed from the front and a schematic perspective view observed from the rear, showing the smoke control damper according to the present disclosure, which is in a perfectly opened state.
Figure 9:
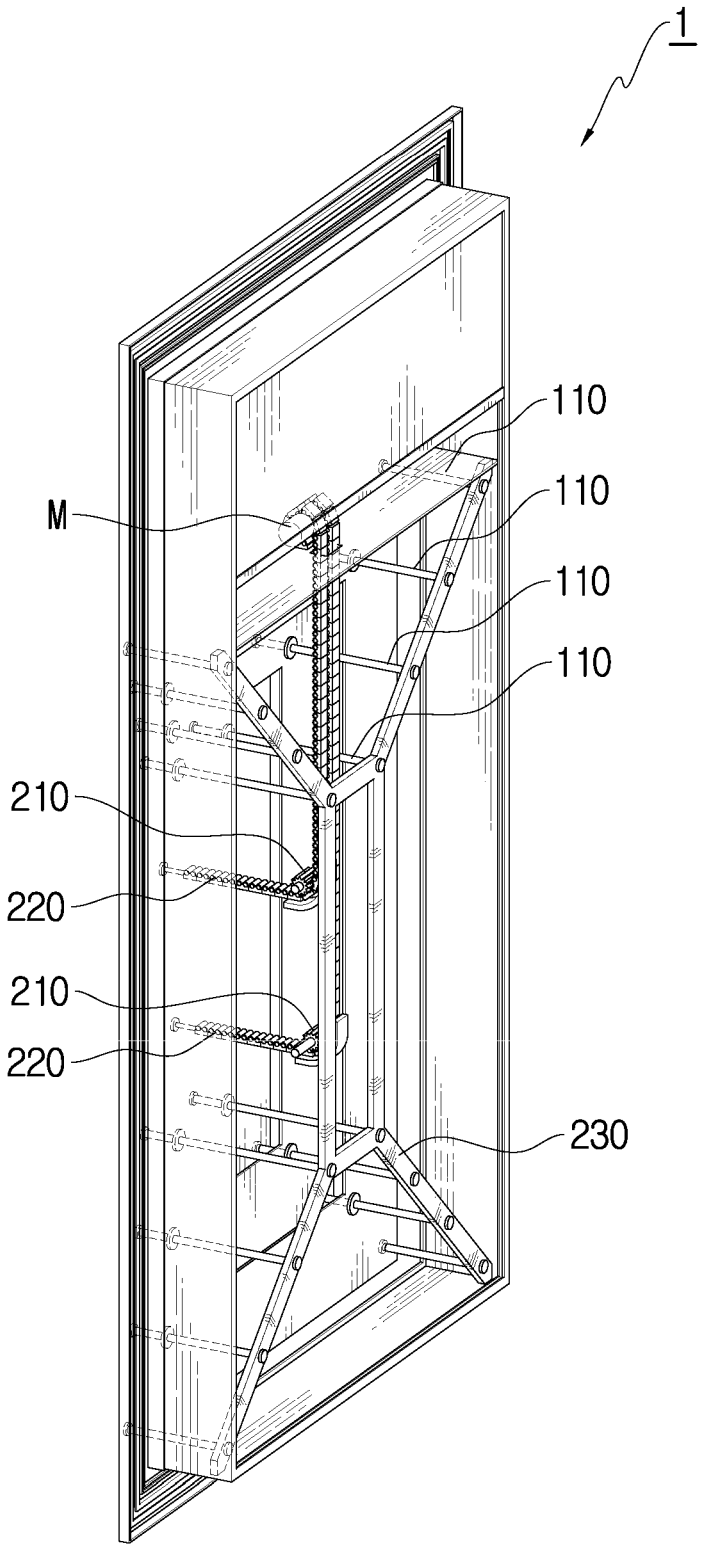
Figure 10:
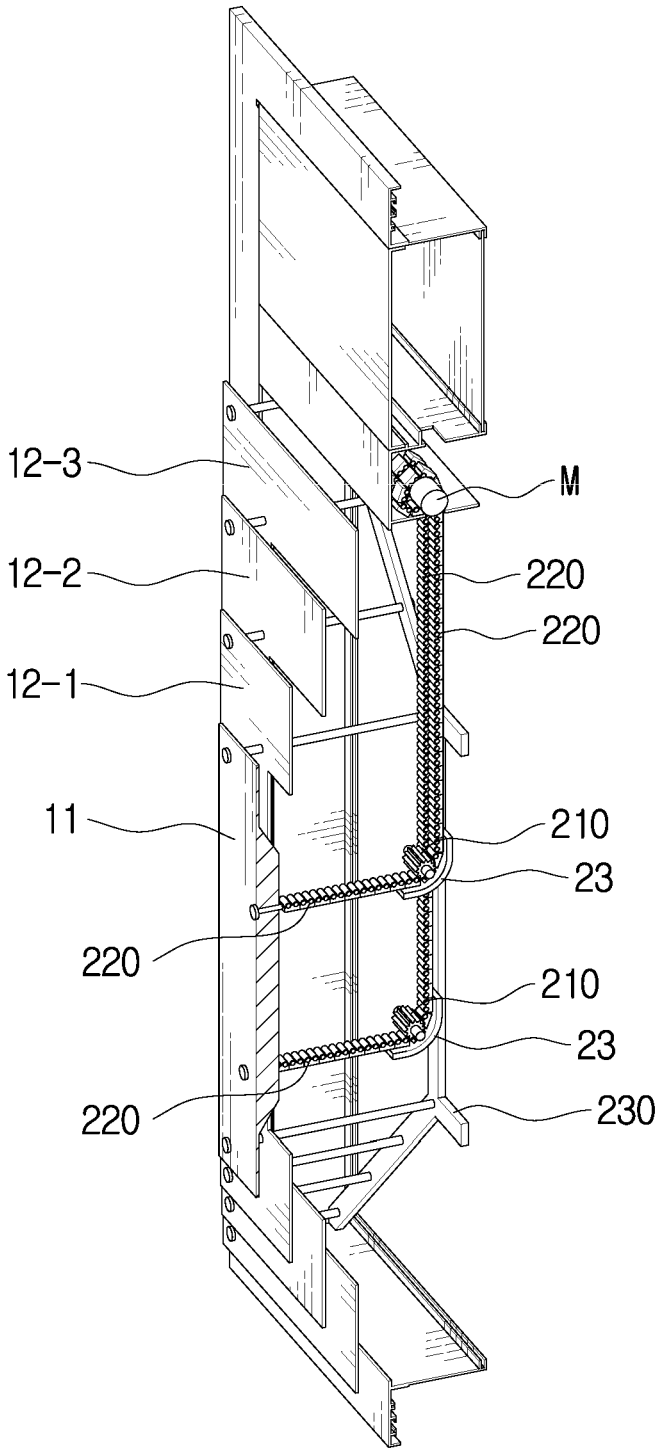
FIG. 10 is a schematic partially-sectioned perspective view in the state depicted in FIGS. 8 and 9.

FIGS. 5 and 6 show only the smoke control damper 1 according to an embodiment of the present disclosure. Here, FIG. 5 is a schematic perspective view showing the smoke control damper 1 in a closed state, observed from the front, and FIG. 6 is a schematic perspective view showing the smoke control damper 1 in a closed state, observed from the rear. FIG. 7 is a schematic partially-sectioned perspective view, taken along the line A-A of FIG. 5. FIGS. 8 and 9 show only the smoke control damper 1 according to an embodiment of the present disclosure. FIG. 8 is a schematic perspective view the smoke control damper 1 in an opened state, observed from the front, and FIG. 9 is a schematic perspective view showing the smoke control damper 1 in an opened state, observed from the rear. FIG. 10 is a schematic partially-sectioned perspective view in the state depicted in FIGS. 8 and 9, which corresponds to FIG. 5. FIGS. 11 to 18 are schematic cross-sectional views showing the smoke control damper according to an embodiment of the present disclosure.

As shown in the figures, the smoke control damper 1 according to the present disclosure includes a central blade 11, a plurality of outer blades 12 arranged in order outwards to surround an edge of the central blade 11, and a blade advancing/retreating device installed at the rear of the central blade 11 to move the central blade 11 forwards or rearwards.

First, in order to describe the central blade 11 and the plurality of outer blades 12 in detail, reference symbols 12-1, 12-2 and 12-3 are endowed to the plurality of outer blades 12 in the order of an outer blade closest to the central blade 11 to outer blades away from the central blade 11. Therefore, in the case the "n" number of outer blades is provided in total, a reference symbol 12-*n* is endowed to the outermost outer blade. However, the reference symbol 12 is used when calling the plurality of outer blades in a bundle. Since three outer blades are depicted in the drawings, the reference symbol 12-*n* is not written in the figures.

In addition, in this specification, with regard to two outer blades adjacent to each other, an outer blade positioned closer to the central blade 11, namely an outer blade having a smaller outer size, is called a "prior-order" outer blade, and an outer blade adjacent thereto and having a larger outer size is called a "posterior" outer blade. Therefore, as described later, with regard to the first outer blade 12-1 and the second outer blade 12-2, the first outer blade 12-1 corresponds to the "prior-order" outer blade, and the second outer blade 12-2 corresponds to the "posterior" outer blade. In addition, in this specification, the direction from the wall of the vestibule at which the smoke control damper 1 is installed toward the center of the vestibule horizontally is called a "front direction", and a direction opposite thereto is called a "rear direction".

As shown in the figures, the outer blades 12 are disposed to surround an outer edge of the central blade 11 and an outer edge of a prior-order outer blade in order. In detail, the central blade 11 is made of a plate member and moves forwards or rearwards in the inner space of the vestibule by the blade advancing/retreating device installed at the rear wall. In addition, the plurality of outer blades 12 is made of a plate member, and an opening is formed at the center of each of the plurality of outer blades 12. An opening of the first outer blade 12-1 adjacent to the central blade 11 corresponds to an outer size of the central blade 11, an opening of the second outer blade 12-2 adjacent to the first outer blade 12-1 corresponds to an outer size of the first outer blade 12-1. In a direction farther and farther from the central blade 11, the relationship between the outer size of a prior-order outer blade and the opening formed at a posterior outer blade adjacent thereto is identically applied to the plurality of outer blades provided at the smoke control damper 1. In other words, the pattern in which an outer edge of a prior-order blade overlaps with an opening edge of a posterior blade repeats to every outer blade. Therefore, an opening of the third outer blade 12-3 adjacent to the second outer blade 12-2 corresponds to an outer size of the second outer blade 12-2, and this relationship repeats. For example, in the case the n number of outer blades is provided, an opening of an nth outer blade 12-*n* corresponds to an outer size of an n−1th outer blade adjacent thereto in a direction toward the central blade.

Here, the expression "an outer size of a prior-order outer blade corresponds to an opening of a posterior outer blade adjacent thereto" should understood as including not only a case in which a size of an opening formed at a posterior outer blade is identical to an outer size of a prior-order outer blade adjacent thereto but also a case in which a size of an opening formed at a posterior outer blade is smaller than an outer size of a prior-order outer blade adjacent thereto as shown in the figures so that an outer edge of the prior-order outer blade overlaps with a front or rear side of an edge of an opening formed at a posterior outer blade adjacent thereto.

As described above, in the present disclosure, the outer edge of the central blade is located to overlap with an opening edge of an outer blade adjacent thereto, and an outer edge of a prior-order outer blade overlaps with an opening edge of a posterior outer blade, which repeats for every outer blade.

If the central blade 11 and the outer blade 12 do not have edges made of a thin plate member but made of a thick member, the outer edges of the central blade 11 and the outer blade 12 are formed to have an inclined surface in which the plate has a gradually decreasing size from the front side to the rear side, and an of a posterior outer blade overlapping therewith is formed to have an inclined surface so that the opening gradually increases from the rear side to the front side, oppositely. In this case, the outer edge of the central blade 11 is disposed to overlap with the inclined edge of the opening formed at the first outer blade 12-1, and the outer edge of the first outer blade 12-1 is disposed to overlap with the inclined edge of the opening formed at the second outer blade 12-2. In this way, a pattern in which an outer edge of a prior-order blade overlaps with an opening edge of a posterior blade may repeat with respect to every outer blade.

A support shaft 110 is horizontally disposed to pass through an overlapping portion of the edge of the central blade 11 and the opening edge of the first outer blade 12-1. Another support shaft 110 is also horizontally disposed to pass through an overlapping portion of the edge of the first outer blade 12-1 and the opening edge of the second outer blade 12-2. As described above, at a portion in which the edge of a prior-order outer blade overlaps with an opening edge of a posterior outer blade, the support shaft 110 is respectively disposed to pass through the overlapping portion.

The support shaft 110 is a member for guiding the central blade 11 and the outer blade 12 to advance or retreat. There is provided a plurality of support shafts 110 at upper and lower sides of the central blade 11, and also there is provided a plurality of support shafts 110 with respect to each outer blade 12. The support shaft formed through the overlapping portion of the edge of the central blade 11 and the opening edge of the first outer blade 12-1 has a front end coupled to the central blade 11, and the support shaft formed through the overlapping portion of the edge of the first outer blade 12-1 and the opening edge of the second outer blade 12-2 has a front end coupled to the first outer blade 12-1. In this way, the front end of the support shaft 110 is respectively fixedly coupled to the central blade 11 and the prior-order outer blade. The rear end of the support shaft 110 is coupled through a shaft coupling plate 230 disposed to be spaced apart from the central blade 11 and the outer blade 12 in the rearward direction. A stopper 119 is provided at the rearmost end of the support shaft 110 which is provided through the shaft coupling plate 230, in order to prevent the support shaft 110 from being excessively pulled.

A hooking member 112 is fixed to the support shaft 110 at a location spaced apart from the rear side of the outer blade 12 by a predetermined distance. When the support shaft advances forwards, the hooking member 112 plays a role of contacting the rear surface of a posterior outer blade adjacent thereto and pulling the posterior outer blade forwards.

In the present disclosure, a blade advancing/retreating device for moving the central blade 11 forwards or rearwards is installed at the rear sides of the central blade 11 and the outer blade 12. The blade advancing/retreating device may have any configuration as long as it may move the central blade 11 forwards and rearwards. In the embodiment depicted in FIGS. 5 to 18, the blade advancing/retreating device includes a chain gear 220 and a motor M for moving the chain gear 220 forwards or rearwards by rotation.

As shown in FIGS. 5 to 18, a motor M and a rotating wheel are located at the rear side of the central blade 11 to be spaced apart from the rear surface of the central blade 11. One end of the chain gear 220 is coupled to the rear surface of the central blade 11. Therefore, if the motor M and the rotating wheel rotate, the chain gear 220 engaged with the rotating wheel moves so that the central blade 11 advances forwards or retreats rearwards. The chain gear 220 is already well known in the art and is generally configured so that blocks are successively disposed at a rear surface of a chain engaged with the rotating wheel, which ensures bending and linear movement simultaneously. In the present disclosure, the chain gear 220 moves straightly in the horizontal direction at the rear of the central blade 11 as shown in the figures. However, considering a case in which a rear space of the central blade 11 is narrow, a redirection plate 23 bent into an "L" shape is installed at the rear of the central blade 11 to be spaced apart from the rear surface of the central blade 11, so that the chain gear 220 moving straightly may be moved in a perpendicular direction by means of the redirection plate 23. In other words, the chain gear 220 which has moved in the horizontal direction along which the central blade 11 advances or retreats may move in a perpendicular direction by means of the redirection plate 23. Reference symbol 210 represents a rotating gear unit 210 located at the front of the redirection plate 23 and engaged with the chain gear 220 to rotate together with the chain gear 220.

In the embodiment shown in the figures, the motor M and the rotating wheel are depicted as being located at an upper portion, but the installation locations of these components are not limited. In addition, the number of chain gears 220 is not limited to the depicted case and may be freely selected, for example one or more.

As described above, the blade advancing/retreating device using a chain gear is very useful when a space at the rear of the central blade 11 and the outer blade 12 is narrow. As described above, the chain gear 220, the redirection plate 23, and the blade advancing/retreating device having the motor M and the rotating wheel require a very small space for installing and operating at the rear of the central blade 11. Therefore, the smoke control damper 1 may be installed in a narrow space at the rear of the wall of the vestibule, and accordingly the installation location of the smoke control damper 1 may be more freely selected.

Next, operation of the smoke control damper 1 according to the present disclosure will be described with reference to FIGS. 11 to 18. For reference, in FIGS. 11 to 18, a thick arrow G represents an air current flowing into the vestibule through the blowing passage.

Figure 11:
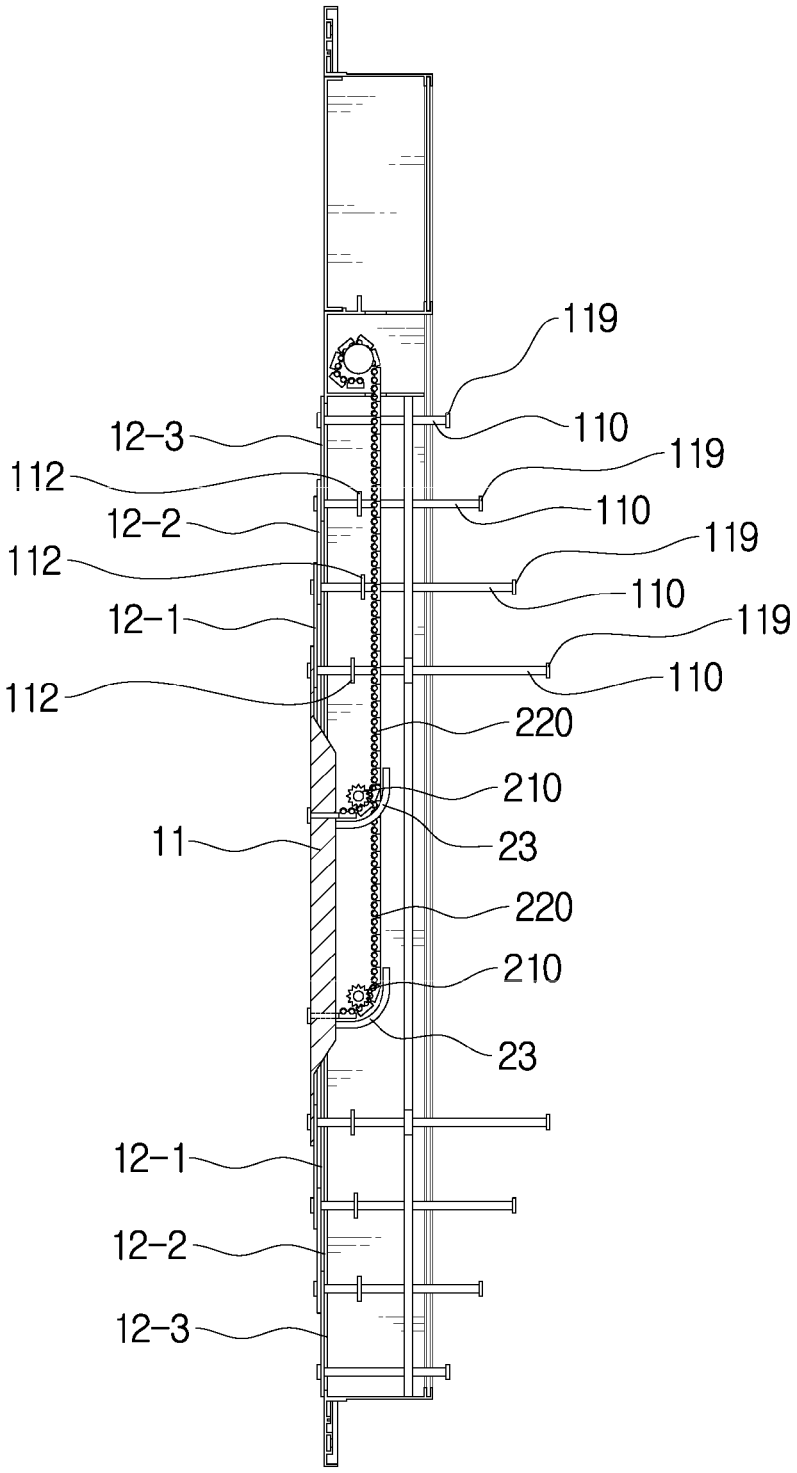
FIGS. 11 to 15 are schematic cross-sectional views showing the smoke control damper according to the present disclosure in which an air current applied toward the vestibule is not strong.

As shown in FIG. 11, in a state where the smoke control damper 1 is perfectly closed, the rotating cam 21 does not press the rear surface of the central blade 11 but just a tensile force from the tensile spring member 22 is applied rearwards. If the rotating cam 21 rotates and presses the rear surface of the central blade 11, the smoke control damper 1 is opened. At this time, an operating procedure varies a little depending on the intensity of an air current of an outside air flowing from the air passage toward the vestibule.

Figure 12:
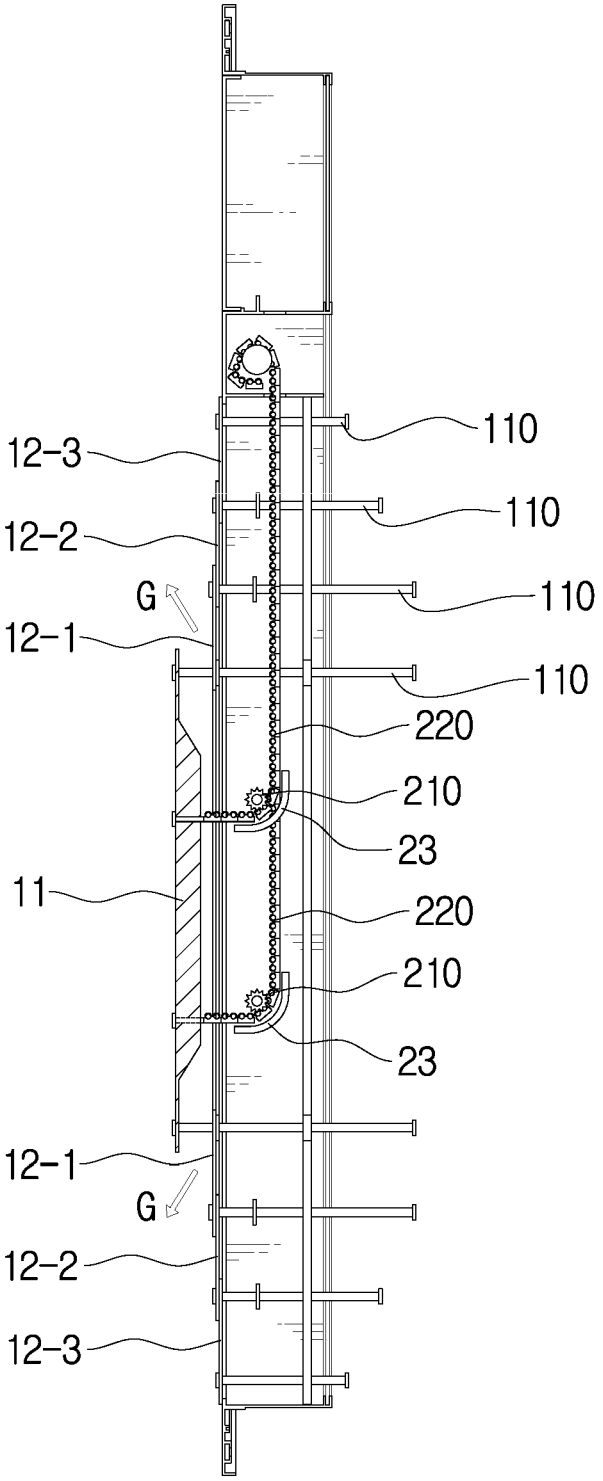

FIGS. 11 to 15 show a case in which an air current applied toward the vestibule is not strong. The case in which an air current applied toward the vestibule is not strong will be described with reference to FIGS. 11 to 15. As shown in FIG. 11, in a state where the smoke control damper 1 is perfectly closed, if the blade advancing/retreating device operates so that the central blade 11 gradually advances forwards, the support shaft 110 coupled thereto also advances forwards. Accordingly, as shown in FIG. 12, a blowing passage is formed between the central blade 11 and the first outer blade 12-1. The outer edge of the central blade 11 overlapping with the opening edge of the first outer blade 12-1 moves due to the advancing of the central blade 11, and accordingly a gap is present between the outer edge of the central blade 11 and the opening edge of the first outer blade 12-1. In other words, a blowing passage is formed. The blowing passage between the outer edge of the central blade 11 and the opening edge of the first outer blade 12-1 is not formed forwards but formed in the vertical direction. In other words, due to the blowing passage, an air current is not formed perpendicular to the smoke control damper 1 toward the front but formed substantially in parallel to the outer surface of the smoke control damper 1. In particular, the blowing passage is entirely formed along the outer edge of the central blade 11.

Figure 13:
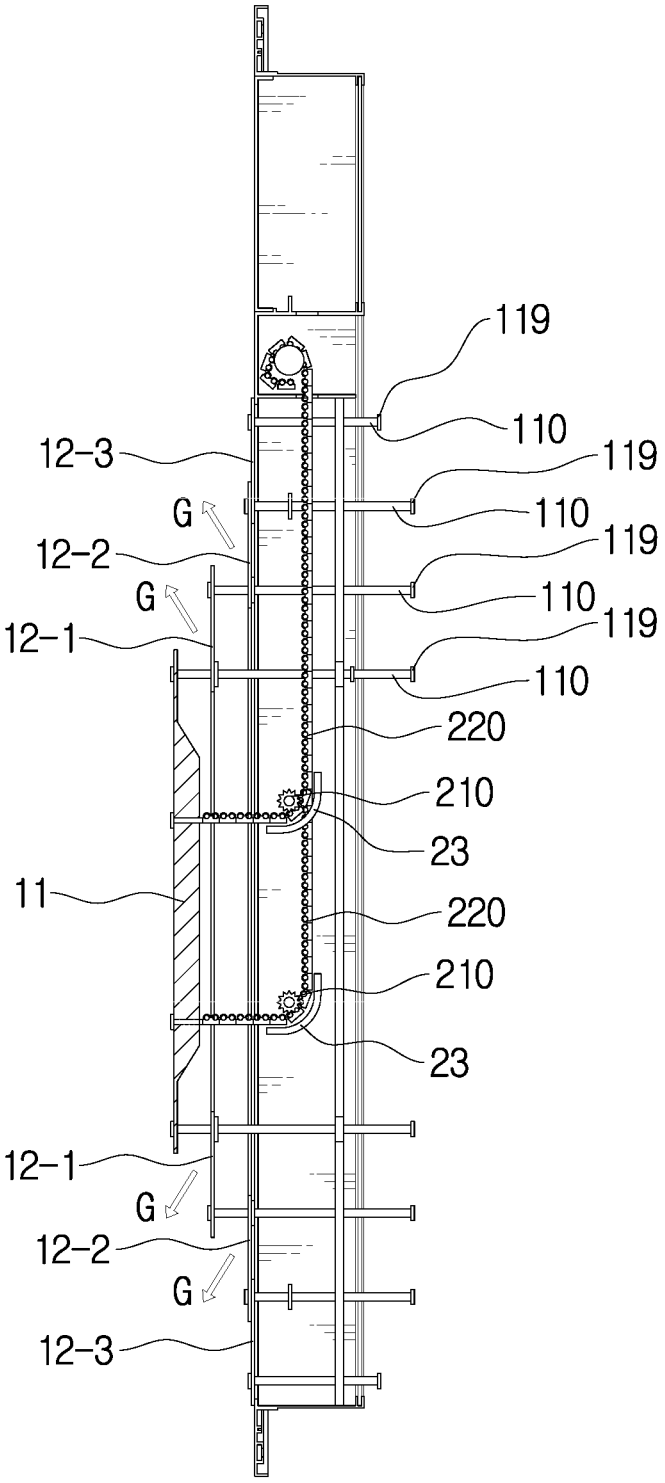

If the central blade 11 advances further in the forward direction due to the operation of the chain gear, the support shaft 110 coupled to the central blade 11 also advances further in the forward direction, and the hooking member 112 provided at the support shaft 110 coupled to the central blade 11 contacts the rear surface of the first outer blade 12-1 and pushes the first outer blade 12-1 forwards as shown in FIG. 13. Accordingly, the outer edge of the first outer blade 12-1 is also separated from the opening edge of the second outer blade 12-2, and a gap is formed between the first outer blade 12-1 and the second outer blade 12-2. In this way, a blowing passage for the air current is created by the gap.

Figure 14:
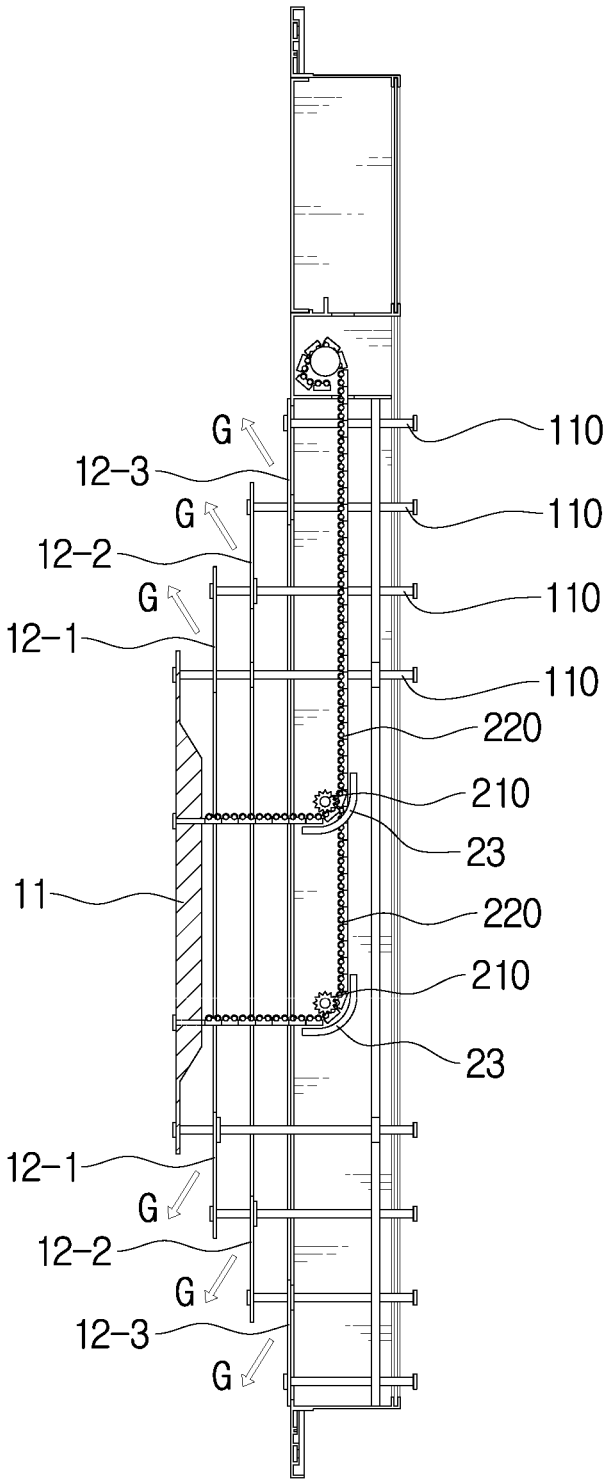

If the central blade 11 advances further in the forward direction, the first outer blade 12-1 also advances further in the forward direction. At this time, the hooking member 112 provided at the second support shaft 110 passing through both the first outer blade 12-1 and the second outer blade 12-2 contacts the rear surface of the second outer blade 12-2. In this state, if the central blade 11 advances further, the second outer blade 12-2 is also pushed forwards by the hooking member 112, so that a gap may be formed between the second outer blade 12-2 and the third outer blade 12-3 as shown in FIG. 14, thereby creating a blowing passage.

Figure 15:
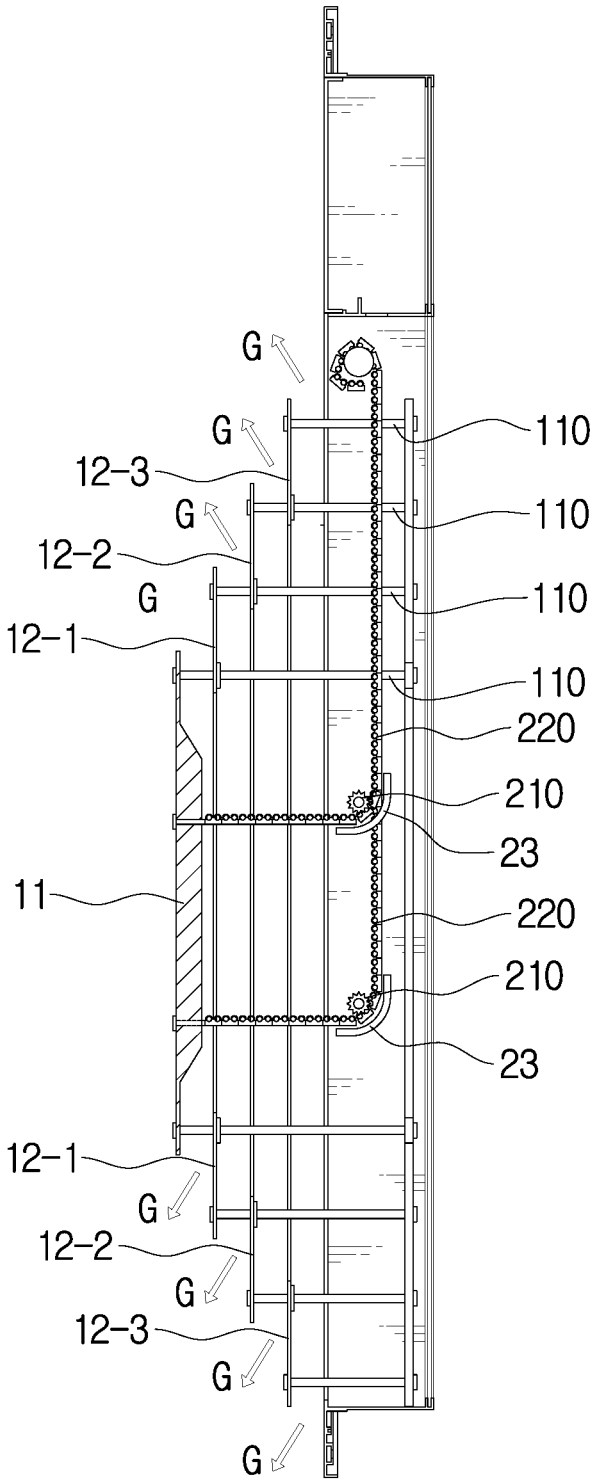

As described above, if the central blade 11 advances forwards, the plurality of outer blades 12 advance in the order of the first outer blade 12-1, the second outer blade 12-2 and the third outer blade 12-3, and accordingly a gap is formed between the prior-order outer blade and the posterior outer blade to create a blowing passage. FIG. 15 shows that the smoke control damper 1 is perfectly opened since all outer blades advance forwards to form the blowing passage not only between the central blade 11 and the first outer blade 12-1 but also between each prior-order outer blade and each posterior outer blade.

Therefore, the air current flows in parallel to the outer surface of the smoke control damper 1 as shown in FIG. 15 through the blowing passage formed by the gaps between the central blade 11 and the first outer blade 12-1 and between the prior-order outer blade and the posterior outer blade and flows into the vestibule. The air current flowing into the vestibule through the smoke control damper 1 according to the present disclosure as described above does not have a specific directional nature but uniformly flows in various directions at the edge of the smoke control damper 1 into the vestibule. Further, in the present disclosure, the air current does not flow in a direction perpendicular to the smoke control damper 1 but in a direction parallel to the outer surface of the smoke control damper 1. In other words, the air current supplied to the vestibule by means of the smoke control damper 1 of the present disclosure is not inclined to a specific direction but may uniformly spread in the vestibule. Therefore, according to the present disclosure, an air egress velocity is formed in a direction capable of preventing smoke from spreading to a shelter door. Moreover, according to the present disclosure, since the smoke control damper may be installed regardless of a location of the shelter door without disturbing opening of the shelter door, limitations in a building designing process may be removed.

The process of closing the smoke control damper 1 is as follows. If the chain gear retreats rearwards, the central blade 11 moves rearwards, and the central blade 11 also moves rearwards so that the first outer blade, the second outer blade and the third outer blade move rearwards in order, thereby closing the smoke control damper 1.

Figure 16:
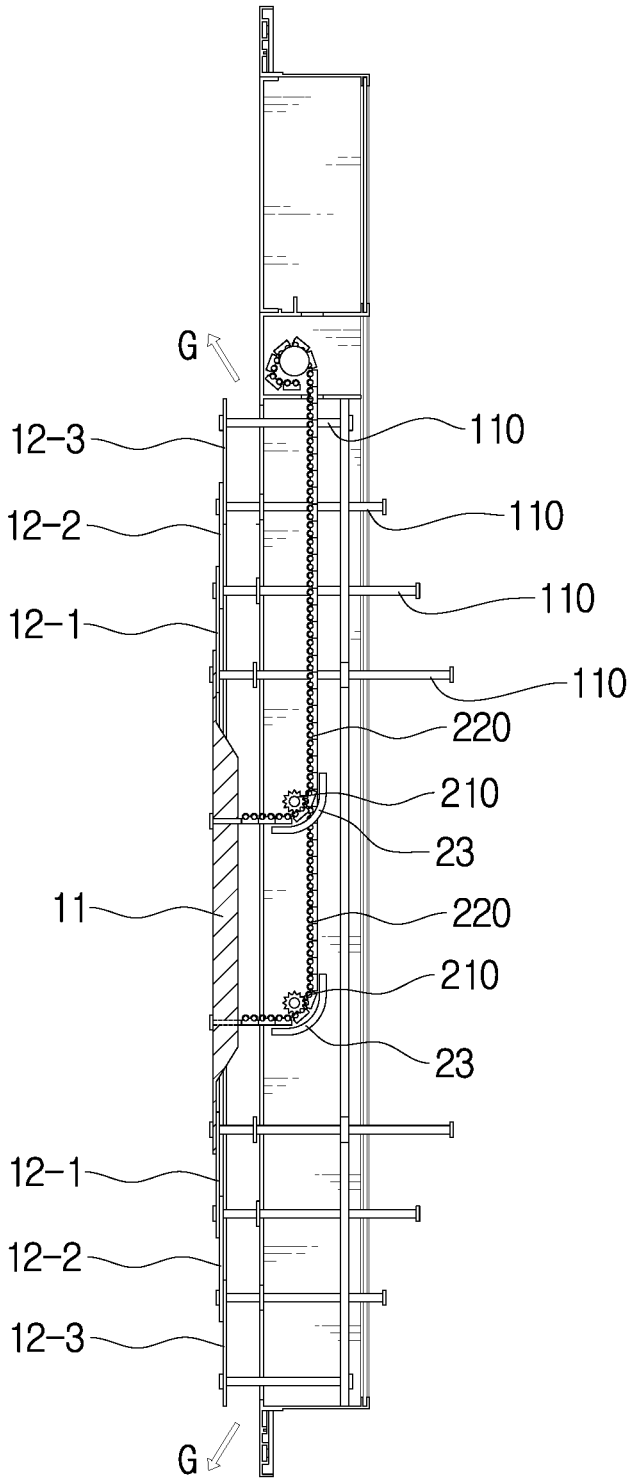
FIGS. 16 to 18 are schematic cross-sectional views showing the smoke control damper according to the present disclosure in which an air current applied toward the vestibule is strong.
Figure 17:
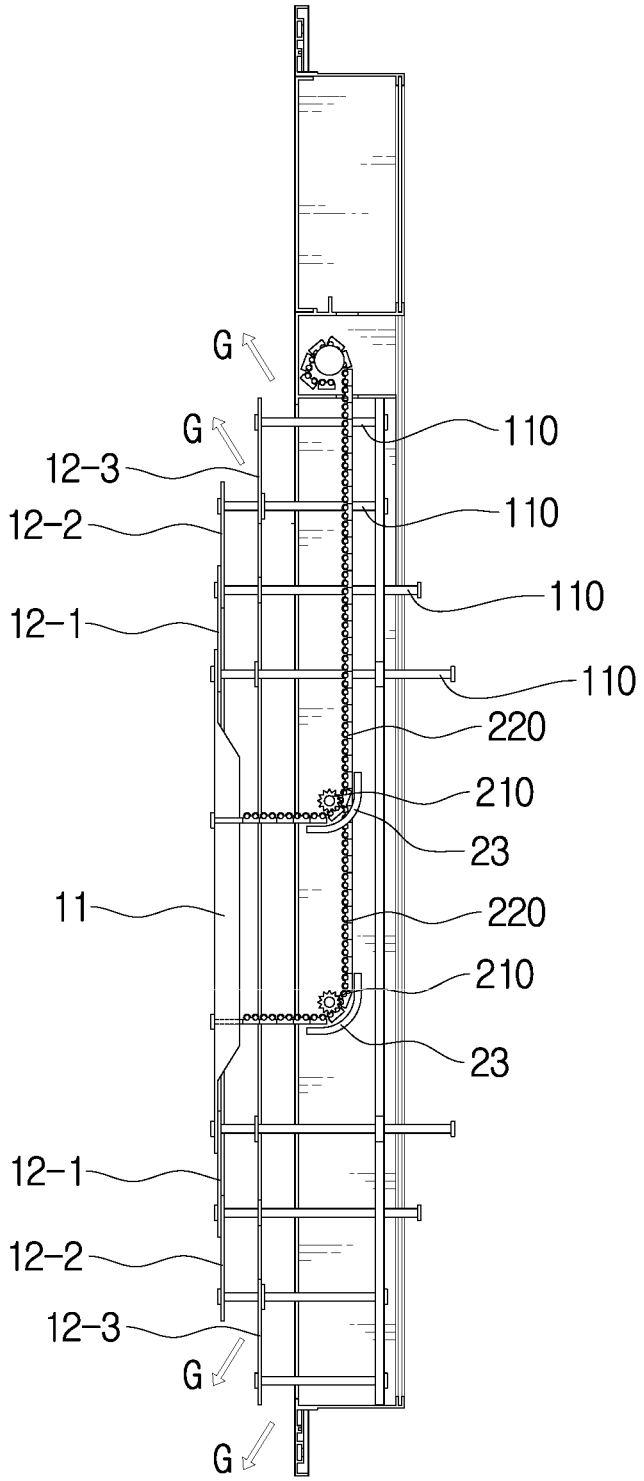
Figure 18:
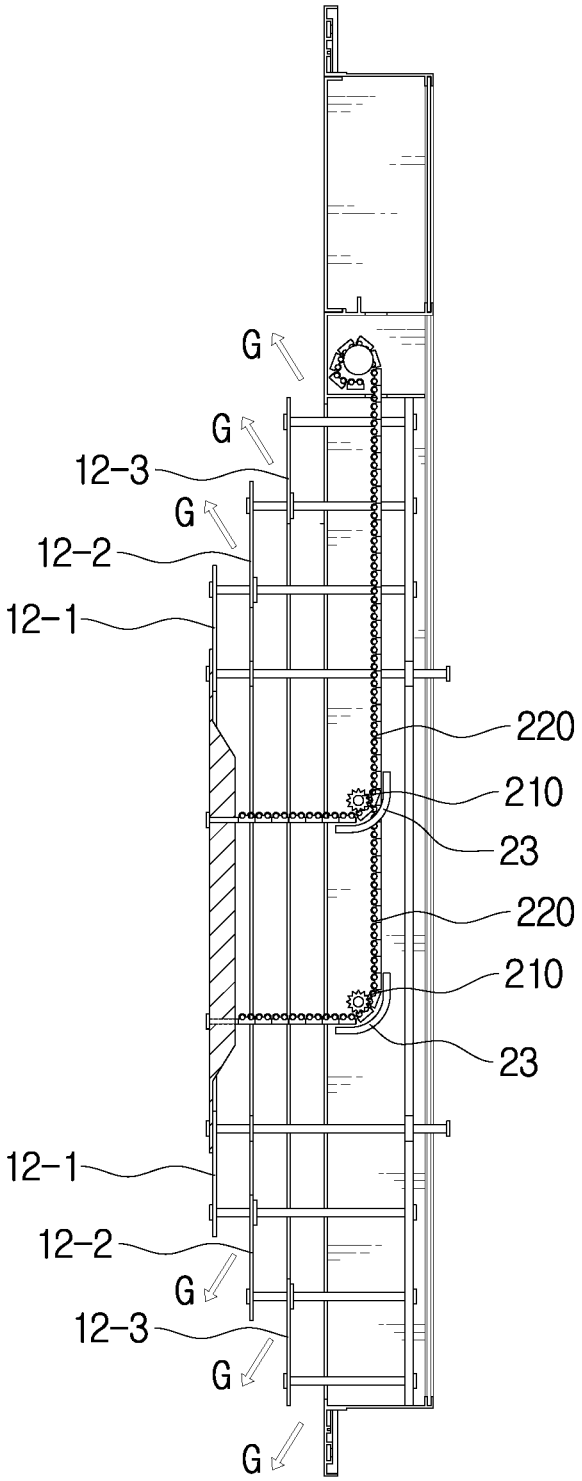

FIGS. 16 to 18 relates to a case in which an air current supplied toward the vestibule is strong. In a state where the smoke control damper 1 is perfectly closed, if the central blade 11 gradually advances forwards by means of the blade advancing/retreating device, the support shaft 110 coupled thereto advances forwards together. In a state where a pressing force for pushing forwards by a strong air current is applied to the rear surface of the outer blade 12, if the support shaft 110 advances forwards together with the central blade 11 as described above, the first outer blade 12-1 is pushed forwards by the pressing force of the air current before the hooking member 112 comes into contact with the first outer blade 12-1. If the first outer blade 12-1 advances forwards as described above, the support shaft 110 coupled to the first outer blade 12-1 advances together, but the second outer blade 12-2 is also pushed forwards by the pressing force of the air current before the hooking member 112 comes into contact with the rear surface of the second outer blade 12-2. As described above, the outer blades 12 are pushed forwards by the pressing force of the air current. If there is present the n number of outer blades in total, the nth outer blade **12-*n* located at the outermost side also advances forwards by means of the pressing force of the air current from the rear surface thereof until the rearmost end of the support shaft 110 coupled to the nth outer blade 12-*n* is hooked by the shaft coupling plate 230 and does not move any more. Therefore, as shown in FIG. 16, in the case three outer blades are provided in total, a blowing passage is formed at the edge of the third outer blade 12-3** corresponding to the outermost outer blade.

In this state, if the central blade 11 gradually advances forwards, outer blades advance forwards by means of the pressing force of the air current as described above, and in the embodiment depicted in the figures, the support shaft 110 provided at the overlapping portion of the second outer blade 12-2 and the third outer blade 12-3 does not move any more, thereby forming a blowing passage between the second outer blade 12-2 and the third outer blade 12-3 as shown in FIG. 17.

This operation repeats so that as shown in FIG. 18, a blowing passage is formed between the first outer blade 12-1 and the second outer blade 12-2. As a result, as shown in FIG. 15, a blowing passage is formed between the central blade 11 and the first outer blade 12-1, so that the smoke control damper 1 is opened perfectly.

In a state where the smoke control damper 1 is perfectly opened, an air current flows into the vestibule in the same way as in the embodiment illustrated in FIGS. 11 to 15 and gives the same effects, and so this is not described in detail here. The process of closing the smoke control damper 1 is identical to the embodiment illustrated in FIGS. 11 to 15 and not described in detail here.

The invention claimed is:

1. A non-directional smoke control damper, comprising:

a central blade;

a plurality of outer blades having an opening and arranged in order to surround an edge of the central blade; and a blade advancing/retreating device for moving the central blade forwards or rearwards, wherein an outer edge of the central blade overlaps with an opening edge of an outer blade adjacent thereto, and an outer edge of a prior-order outer blade among the plurality of outer blades overlaps with an opening edge of an adjacent posterior outer blade, wherein a support shaft is respectively disposed through the overlapping edges, wherein a rear end of the support shaft is coupled through a shaft coupling plate, wherein the blade advancing/retreating device includes:

a motor located spaced apart from a rear surface of the central blade;

a rotating wheel configured to pivot by the motor; and a chain gear having one end coupled to the rear surface of the central blade, the chain gear being engaged with the rotating wheel to move by means of pivotal movement of the rotating wheel, which makes the central blade advance or retreat, wherein when the central blade advances forwards by the blade advancing/retreating device, the plurality of outer blades advance forwards in order, forming a gap at each edge between the central blade and an adjacent outer blade and between a prior-order outer blade and a posterior outer blade to create a blowing passage, thereby allowing an air current to flow into a vestibule through the blowing passage.

2. The non-directional smoke control damper according to claim 1, wherein a redirection plate is installed at the rear of the central blade with a gap from the rear surface of the central blade and allows the chain gear disposed and moved in the vertical direction to move in the horizontal direction along which the central blade advances or retreats.

* * * * *